United States Patent [19]

Sakaida et al.

[11] Patent Number: 4,792,247

[45] Date of Patent: Dec. 20, 1988

[54] ARMATURE SUPPORTING STRUCTURE OF A PRINT HEAD

[75] Inventors: Atsuo Sakaida, Gifu; Yoshihumi Suzuki, Ena; Shigeki Kato, Chiryu, all of Japan

[73] Assignee: Brother Kogyo Kabushiki Kaisha, Japan

[21] Appl. No.: 79,640

[22] Filed: Jul. 30, 1987

[30] Foreign Application Priority Data

Jul. 31, 1986 [JP] Japan ..... 61-180435

[51] Int. Cl.[4] ..... B41J 3/12

[52] U.S. Cl. ..... 400/124; 101/93.05

[58] Field of Search ..... 400/124, 157.2; 101/93.04, 93.05, 93.48; 335/274–276

[56] References Cited

U.S. PATENT DOCUMENTS

| | | | |
|---|---|---|---|
| 4,204,778 | 5/1980 | Miyazawa et al. | 400/124 |
| 4,225,250 | 9/1980 | Wagner et al. | 400/124 |
| 4,348,120 | 9/1982 | Isobe et al. | 400/124 |
| 4,375,338 | 3/1983 | Mitsuishi | 400/124 |
| 4,403,875 | 9/1983 | Asano et al. | 400/124 |
| 4,411,538 | 10/1983 | Asano et al. | 400/124 |
| 4,618,277 | 10/1986 | Asano et al. | 400/124 |
| 4,634,301 | 1/1987 | Sakaida | 400/124 |
| 4,652,158 | 3/1987 | Asano | 400/124 |

FOREIGN PATENT DOCUMENTS

| | | | |
|---|---|---|---|
| 53-140116 | 12/1978 | Japan | 101/93.04 |
| 59-79343 | 5/1984 | Japan | 400/124 |
| 78759 | 5/1985 | Japan | 400/124 |
| 165258 | 8/1985 | Japan | 400/124 |
| 168662 | 9/1985 | Japan | 400/124 |
| 49854 | 3/1986 | Japan | 400/124 |
| 123547 | 6/1986 | Japan | 400/124 |

*Primary Examiner*—Paul T. Sewell

*Attorney, Agent, or Firm*—Jones, Tullar & Cooper

[57] ABSTRACT

A supporting plate, which is formed of a bendable plate material, includes coupling portions extending in the radial direction of the supporting plate and individually fixing armatures arranged radially, torsion bars paired so as to extend sideways from their corresponding coupling portions, at positions corresponding the respective proximal end portions of the armatures, and leaf spring members paired so as to be fixed to their corresponding armatures by means of the coupling portions, at positions inside the proximal end portions of the armatures, with respect to the radial direction, and to extend radially inward. The leaf spring members are arranged on either side of each armature. Each spring member has an arm portion bendable in the longitudinal direction of its corresponding armature. If the armatures are pulled and swung by means of electromagnetic devices, the torsion bars are twisted, and the leaf spring members are bent. Thus, the armatures are supported and subjected to a resilient force in the restoring direction.

13 Claims, 6 Drawing Sheets

ARMATURE SUPPORTING STRUCTURE OF A PRINT HEAD

BACKGROUND OF THE INVENTION

The present invention relates to a print head in which print wires are moved to a printing position by swinging armatures by means of energized coils, and more particularly, to an armature supporting structure thereof.

Conventionally, in some conventional print heads of this type, a plurality of armatures are swingably supported on a head body by means of leaf springs, individually, and print wires are moved to a printing position by swinging the armatures.

In these conventional print heads, however, the armatures are supported with the aid of the leaf springs, which are bound to suffer a prolonged high-order vibration, after the printing wires strike against printing paper, or after they return to a rest position after printing operation. Thus, it takes the leaf springs much time to be restored to their original position. As a result, the printing cycle becomes too long for high-speed printing.

Some arrangements have been proposed as a measure to counter the high-order vibration. In one such arrangement, as shown in FIG. 8, the proximal end portion of each of armatures 1 is swingably mounted on a head body 3 by means of a pair of torsion bars 2, for use as resilient members. Each armature 1 is swung by energy which is accumulated by a twist of the torsion bars 2. By doing this, one of print wires 4, which are fixed individually to the free end portions of the armatures, is moved to the printing position.

In the prior art print head constructed in this manner, however, each armature 1 is supported only by a pair of torsion bars 2, so that the bar 2 are subjected to stress concentration. Thus, the torsion bars 2 are lowered in durability, so that the life of the print head is shortened.

SUMMARY OF THE INVENTION

The present invention is intended to settle the aforementioned problems, and has an object to provide an armature supporting structure of a print head, which can shorten the period of time during which armatures vibrate after printing operation, thereby permitting high-speed printing, and which can ease stress concentration on torsion bars to improve the durability of a resilient member, thereby lengthening the life of the whole print head.

In order to achieve the above object, according to the present invention, there is provided an armature supporting structure which is basically constructed so that torsion bars, attached to a resilient supporting member, are coupled to armatures in a first position along the longitudinal direction thereof, and leaf spring members are provided on the resilient supporting member. The leaf spring members, which each have an arm portion bendable in the longitudinal direction of the armatures, are coupled to the armatures in a second position different and at a distance from the first position.

As the armatures swing, in the arrangement of the present invention described above, twisting and bending moments are applied to the torsion bars and the leaf spring members, respectively. Accordingly, stress concentration on the torsion bars is eased, so that the print head is improved in durability. Also, the period of time during which armatures vibrate after printing operation can be shortened, so that the printing cycle time can be shortened. Thus, the arrangement of the invention can effect high-speed printing. Since the torsion bars can avoid stress concentration, moreover, the durability of the resilient member, and hence, the life performance of the whole print head, can be improved.

In a preferred specific arrangement of the present invention, the resilient supporting member includes coupling members which extend in the longitudinal direction of their corresponding armatures, in order to fix the armatures. The coupling members are formed integrally with the torsion bars and the leaf spring members, by punch-pressing or etching a flat plate material.

In another preferred specific arrangement, moreover, the resilient supporting member is in the form of a ring around the axis of the print head, and the coupling portions, which extend in the radial direction, are arranged circumferentially at predetermined intervals, on the supporting member, so as to correspond to the armatures arranged radially. A pair of torsion bars and a pair of leaf spring members are provided for each coupling portion. All these components are formed at a time by punch-pressing or etching a flat plate material. Thus, the aforementioned advantages of the present invention can be ensured.

BRIEF DESCRIPTION OF THE DRAWINGS

FIGS. 1 to 6 show a first embodiment of the present invention, in which

FIG. 1 is a partial exploded perspective view showing a principal part of a print head, FIG. 2 is a cutaway side view of the print head, FIG. 3 is a sectional view taken along line 3—3 of FIG. 2, FIG. 4 is an exploded perspective view of the print head, FIG. 5 is an enlarged sectional view taken along line 5—5 of FIG. 3, and FIG. 6 is a sectional view taken along line 6—6 of FIG. 5;

DETAILED DESCRIPTION OF THE PREFERRED EMBODIMENTS

Referring now to FIGS. 1 to 6, a first embodiment of the present invention will now be described in detail.

Figure 2:
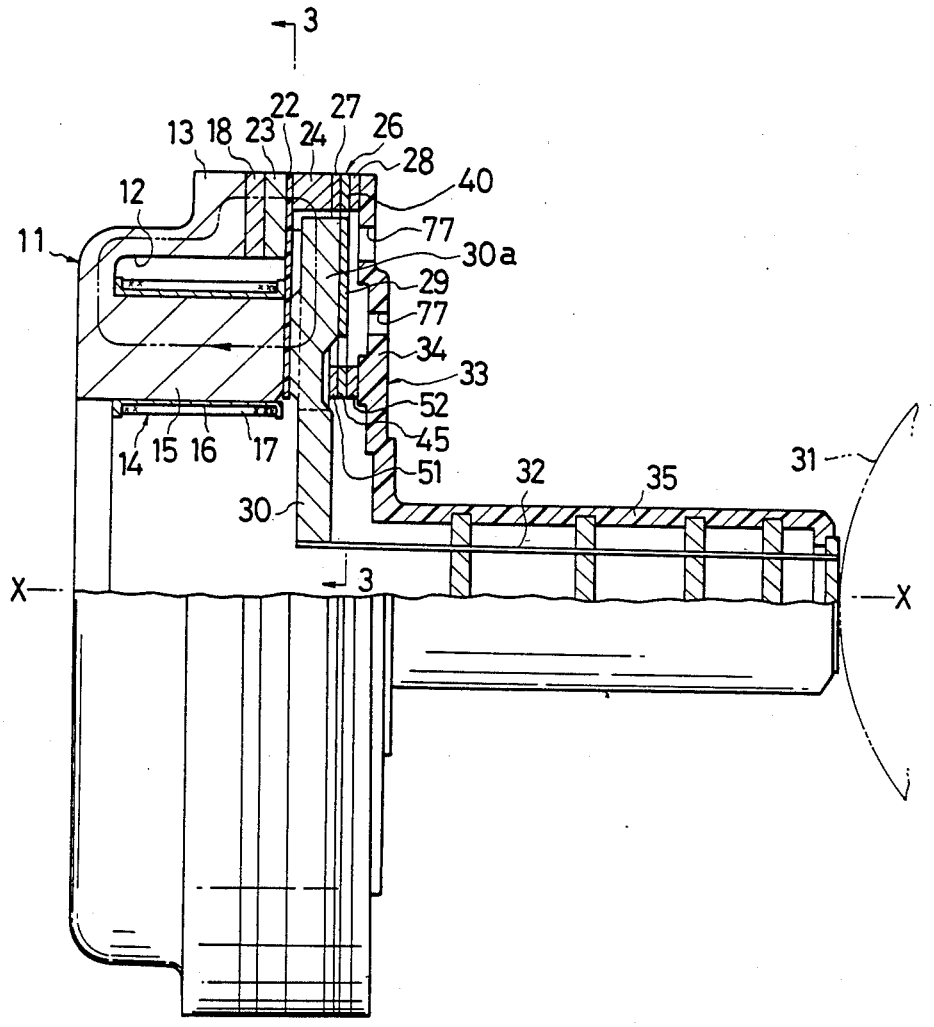
Figure 3:
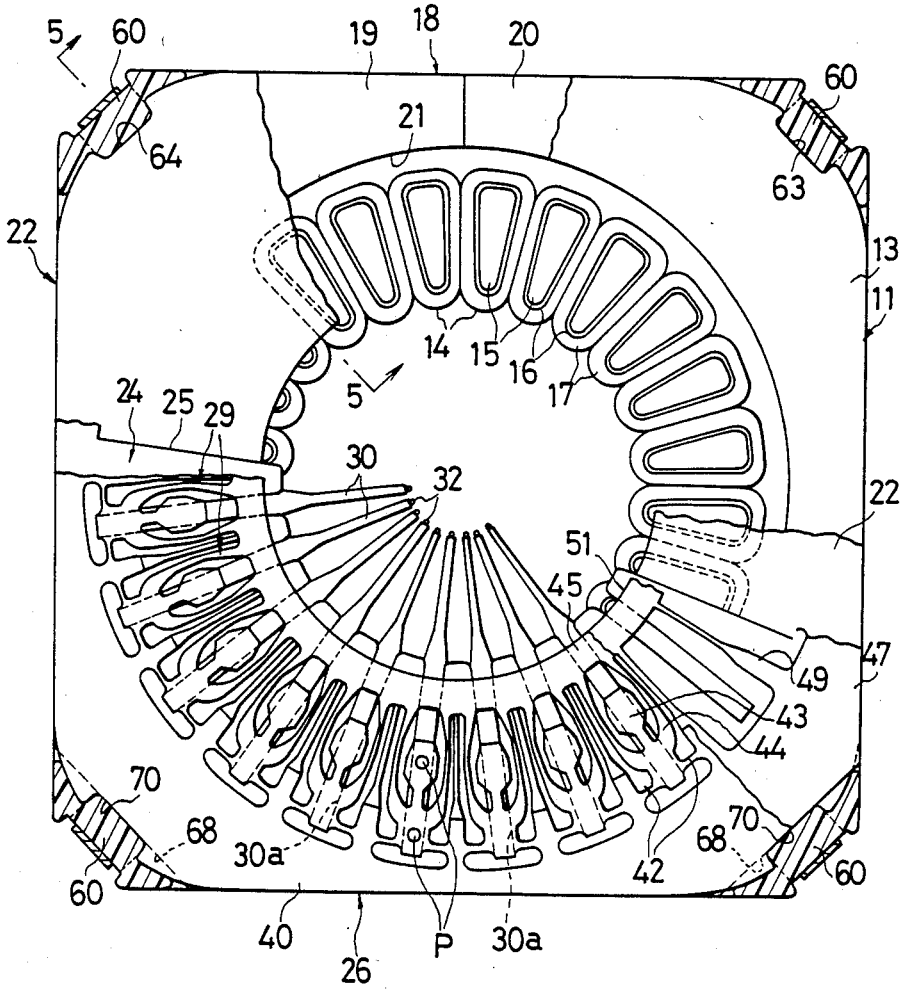

As shown in FIGS. 2 and 3, a body 11 of a print head, which is made of a magnetic material, has a circular recess 12 opening toward a platen 31. A bottom wall and a cylindrical outer peripheral wall of the head body 11 constitute a rear yoke 13. A flange portion 13*a* extends outward from the platen-side end face (hereinafter referred to as a front end face) of the rear yoke 13. The flange portion 13*a* has a rectangular configuration, as viewed from the platen side, including top and bottom sides, extending parallel to the axis of the platen 31 or the traveling direction a carriage (not shown) carrying the print head thereon, and two lateral sides extending at right angles to the top and bottom sides. A plurality of electromagnetic devices 14 are arranged in a ring, on the bottom surface of the recess 12. Each electromagnetic device 14 is composed of a core 15 protruding integrally from the head body 11, a coil bobbin 16 fitted on the core 15, and a coil 17 wound around the bobbin 16. The respective cores 15 of the devices 14 are arranged at regular angular intervals on the head body 11.

Figure 4:
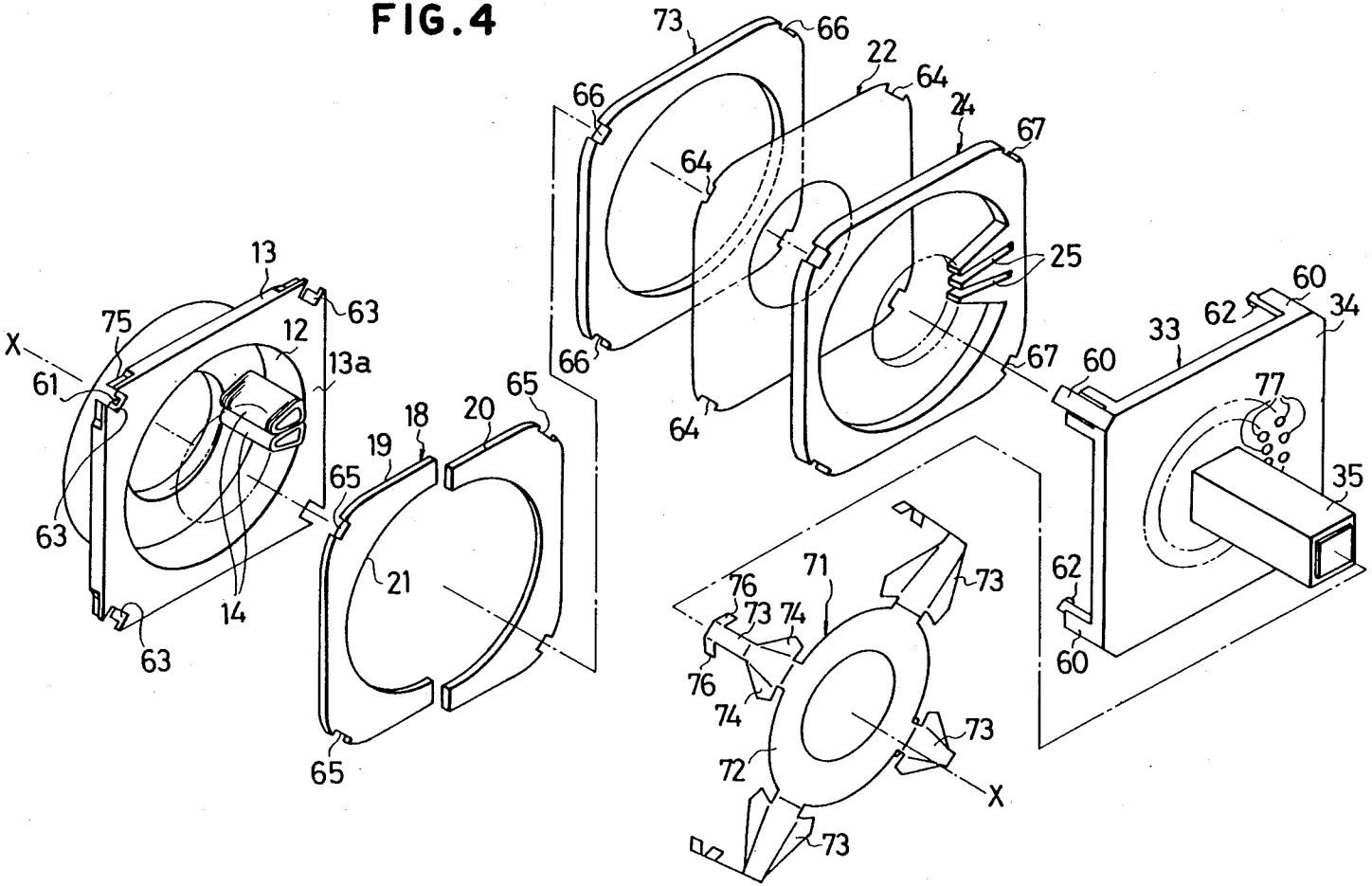

A platelike permanent magnet 18 is fixedly bonded to the front face of the rear yoke 13. As shown in FIG. 4, the permanent magnet 18 is formed of a pair of half pieces 19 and 20 arranged symmetrically. The paired pieces 19 and 20 are fixedly bonded to each other at their facing end portions. Each of the pieces 19 and 20 has the same rectangular external shape as the flange portion 13*a* of the rear yoke 13. The permanent magnet 18 is formed with a center opening 21, which is concentric with the circle along which the cores 15 are arranged. Having a rectangular external shape, the magnet 18 is additionally long in its diagonal direction. Even if its width or side length is minimized, therefore, the whole permanent magnet 18 can secure a satisfactory magnetic force.

A spacer 23, made of magnetic material, is fixed on the front face of the permanent magnet 18, and a front yoke 24 is fixedly bonded to the spacer 23. The front yoke 24 is formed with a plurality of slits 25 which extend radially, facing their corresponding electromagnetic devices 14. The spacer 23 and the front yoke 24 have the same rectangular external shape as the permanent magnet 18. An anti-wear film 22 is interposed between the front yoke 24 and the spacer 23, covering the respective end faces of the cores 15. The film 22 is made of heat-resistant, anti-wear polyimide.

Figure 1:
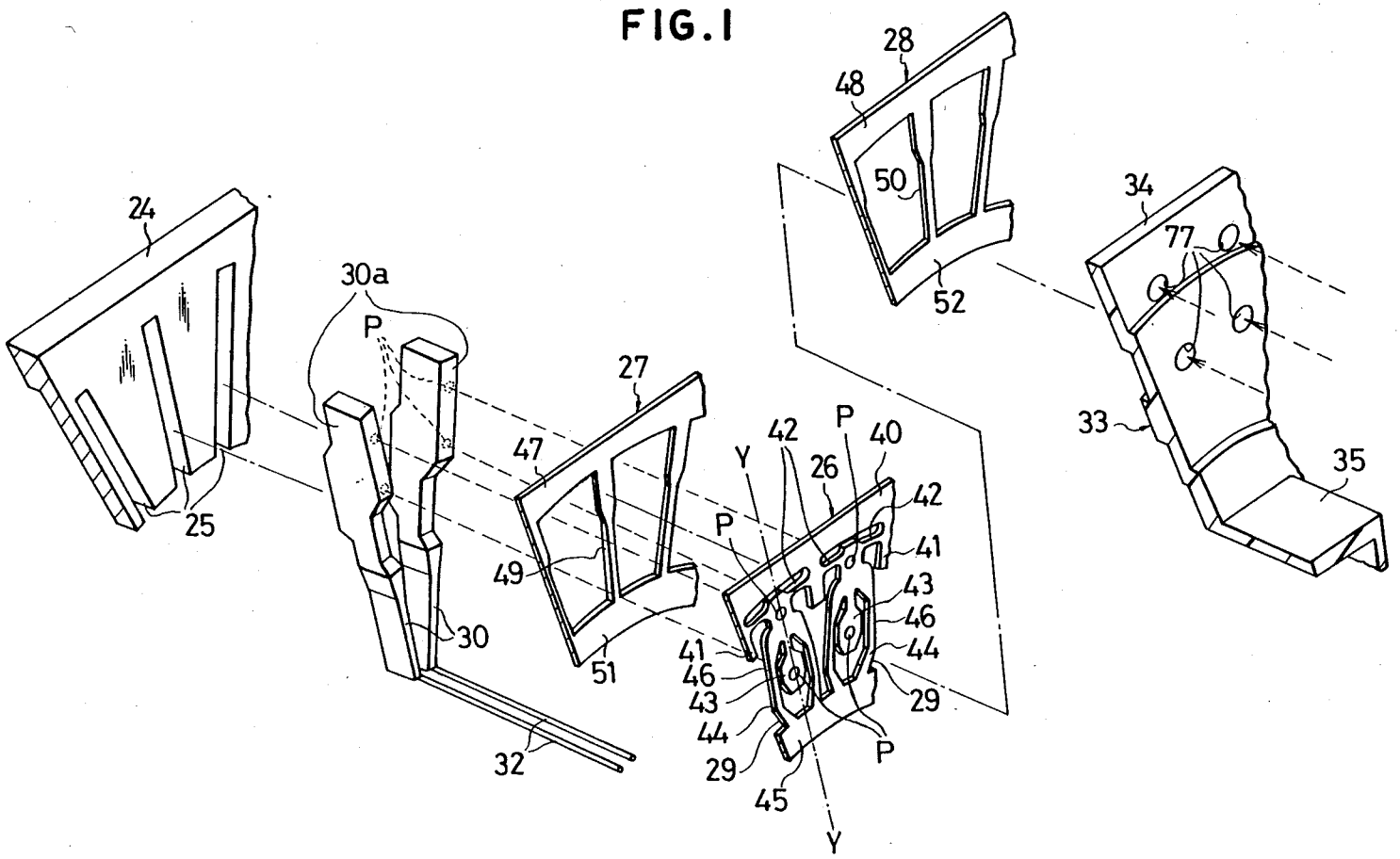

As shown in FIGS. 1, 2 and 3, a supporting plate 26, as resilient supporting means, formed of a bendable resilient plate member, is fixedly bonded to the front side or the platen side of the front yoke 24, so as to be held between a pair of magnetic spacers 27 and 28. A plurality of armatures 30, made of magnetic material, are swingably supported, at their proximal end portions 30*a*, by supporting pieces 2 of the supporting plate 26. The armatures 30 are arranged at predetermined angular intervals. The respective proximal end portions of the armatures 30 are located inside their corresponding slits 25 of the front yoke 24. Print wires 32, which are located collectively at the central portion of the head body 3 so as to extend toward the platen 31, as shown in FIG. 2, are attached, at their proximal ends, to the distal end portions of their corresponding armatures 30.

Figure 7:
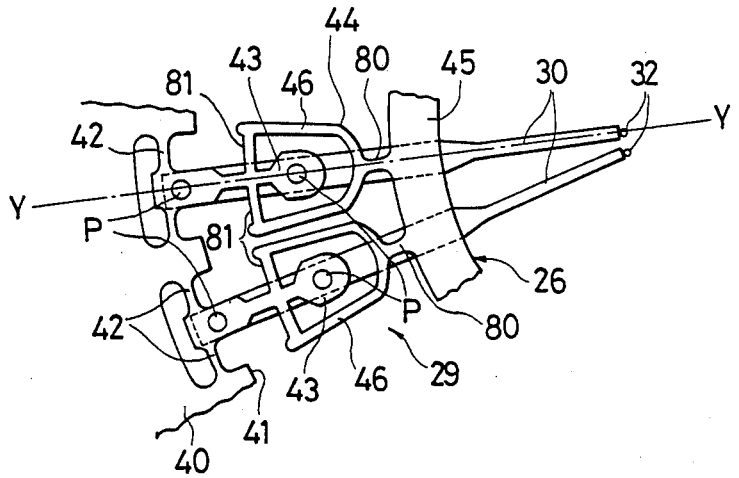
FIG. 7 is a partial enlarged view of a second embodiment of the invention, showing an armature supporting structure.
Figure 8:
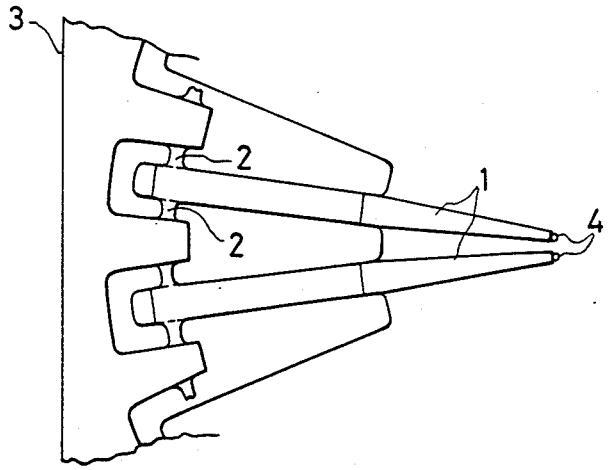
FIG. 8 PRIOR ART
FIG. 8 is a partial enlarged view showing an armature supporting structure in a prior art print head.

The supporting plate 26 is in the form of a ring around a central axis X—X (FIGS. 2 and 4) of the print head, and the supporting pieces 29 are formed so that their corresponding armatures 30 are arranged around the axis X—X, extending in a radial direction Y—Y (FIGS. 1 and 7).

A plastic nose 33, which is attached to the front face of the spacer 28, includes a flat plate portion 34, covering the armatures 30, and a cylindrical guide portion 35 projecting forward. The flat plate portion 34 is fixedly bonded to the spacer 28, and the print wires 32 are movably inserted in the guide portion 35.

A supporting structure for the armatures 30 will now be described in detail. As shown in FIGS. 1 and 3, the supporting plate 26, which is in the form of a ring around the axis X—X, as mentioned before, is provided with a peripheral edge portion 40. The edge portion 40 constitutes a first fixed member which is fixed by the spacers 27 and 28 when the print head is assembled. A plurality of base portions 41 protrude radially toward the center of the print head, from the inner periphery of the peripheral edge portion 40. A pair of torsion bars 42, situated corresponding to the proximal end 30*a* of each armature 30, are formed integrally between each two adjacent base portions 41. A coupling portion 43 extends radially between each pair of torsion bars 42 so as to be integral therewith. Each armature 30 is bonded to its corresponding coupling portion 43, and is welded thereto at two points P by means of electron beams, as mentioned later.

A pair of bending leaf spring portions 44 are arranged on either side of each coupling portion 43, and a coupling ring 45, as a second fixed member, is disposed in the vicinity of the central portion of the print head. The coupling ring 45 is a circular ring having the same diameter as the circular ring along which the electromagnetic devices 14 are arranged. The ring 45 is fixed by the spacers 27 and 28 when the head is assembled. One end of each leaf spring portion 44 is coupled to the coupling portion 43, at a position (second position) near each corresponding torsion bar 42. The second position is inside the position (first position) at which the torsion bar 42 is coupled to the armature 30, with respect to the radial direction. The other end of each leaf spring portion 44 extends radially inward, and is connected to the coupling ring 45. An arm 46 is formed in the middle portion of each leaf spring portion 44, extending parallel to each armature 30. The arm 46 can be bent easily along the longitudinal direction of the armature 30. The paired torsion bars 42, the coupling portion 43, and the paired bending leaf spring portions 44 constitute each of the supporting pieces 29 as resilient members for supporting the armatures 30. The supporting pieces 29, which extend radially, are arranged over the whole circumference of the supporting plate 26. Each supporting piece 29 has a symmetrical configuration with respect to the axis Y—Y. A plurality of supporting plates 26 are produced at a time by punch-pressing or etching a flat plate material.

Meanwhile, the spacers 27 and 28 are formed with coupling arms 49 and 50, respectively, which extend from their corresponding peripheral edge portions 47 and 48 toward the regions between the leaf spring portions 44. Also, the spacers 27 and 28 have coupling rings 51 and 52 which are concentric with the coupling ring 45 of the supporting plate 26. The center-side end portions of the coupling arms 49 and 50 are connected to the coupling rings 51 and 52, respectively. The base portions 41 of the supporting plate 26 are held between their corresponding coupling arms 49 and 50, while the coupling ring 45 of the supporting plate 26 is sandwiched between the coupling rings 51 and 52. The coupling rings 45, 51 and 52 are fixedly held between the front face of the central portion of the front yoke 24 and the rear face of the flat plate portion 34 of the nose 33.

As shown in FIG. 4, four positioning projections 60 protrude integrally rearward from the four corners of the flat plate portion 34 of the nose 33. A retaining piece 62 for tacking is formed integrally on the extreme end of each positioning projection 60. The retaining pieces 62 are adapted individually to engage notches 61 in the rear face of the rear yoke 13. Meanwhile, engaging portions 63, 64, 65, 66, 67, 68, 69 and 70 are formed at the four corners of the rear yoke 13, permanent magnet 18, spacer 23, film 22, front yoke 24, spacers 27 and 28, and supporting plate 26, respectively. These engaging portions are adapted to engage their corresponding positioning projections 60. The members 13, 18, 23, 22, 24, 27, 28 and 26 are successively put on the flat plate portion 34 in a manner such that the engaging portions 63 to 70 thereof are in engagement with the positioning projections 60.

A coupling member 71, formed of a spring material, is mounted, at its central ring-shaped portion 72, on the front face of the nose 33. Four protrusions 73, bent substantially at right angles, protrude radially from the outer periphery of the coupling member 71, at regular intervals. A pair of resilient pieces 74 are integrally formed on the opposite sides of the proximal end portion of each protrusion 73, individually, by bending. The resilient pieces 74 are adapted to engage the front face of the plate portion 34 of the nose 33. A pair of retaining pieces 76, which can engage retaining recesses 75 in the rear face of the rear yoke 13, are formed integrally on the distal end of each protrusion 73 by bending.

Figure 5:
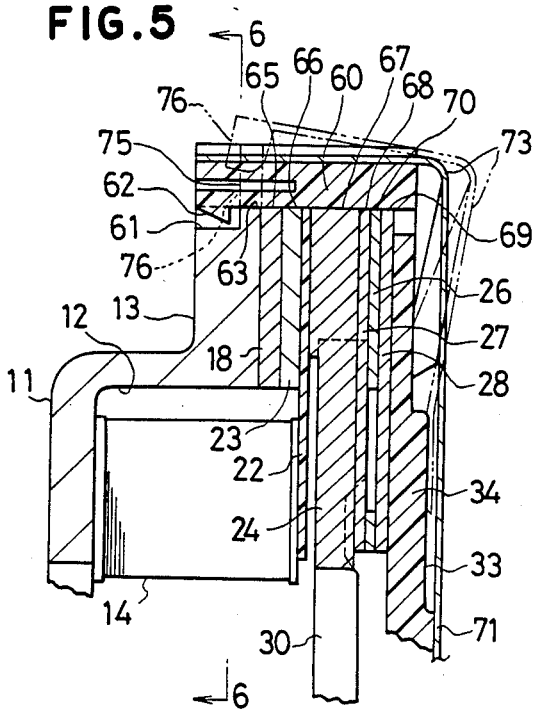
Figure 6:
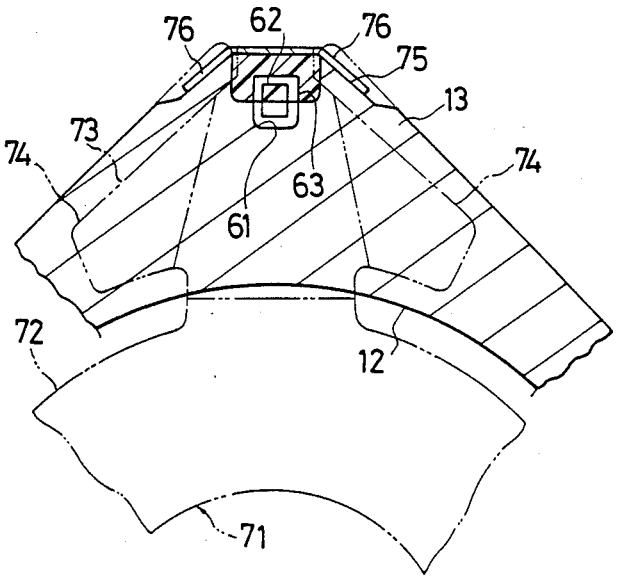

In a natural state, as indicated by two-dot chain line in FIG. 5, the retaining pieces 76 of each protrusion 73 are situated off their corresponding retaining recesses 75. In this state, if the respective distal ends of the protrusions 73 are pressed against their corresponding corners of the head body 11, resisting their own resilience, the retaining pieces 76 engage their corresponding retaining recesses 75, as indicated by full line in FIG. 5. At the same time, the resilient pieces 74 are brought resiliently into contact with the flat plate portion 34. Thus, the components arranged in layers between the head body 11 and the nose 33 are held and fixed in place.

The operation of the print head, constructed in this manner, will now be described.

When none of the coils 17 of the electromagnetic devices 14 are energized, the permanent magnet 18 forms a magnetic path extending through the spacer 23, front yoke 24, armatures 30, cores 15, and rear yoke 13, as indicated by two-dot chain line in FIG. 2. Thereupon, the armatures 30 are swung around the torsion bars 42 and attracted to the whole end faces of the cores 15, so that the print wires 32 are situated in a rest position on the rear side. As a result, torsional energy produced by a twist is accumulated in the torsion bars 42, and the junctions between the bending leaf spring portions 44 and the coupling portions 43 are moved rearward. Thus, torsional energy produced by bending is accumulated in the leaf spring portions 44 whose fixed ends are coupled to the coupling ring 45.

In this state, if the coils 17 of the electromagnetic devices 14 are energized selectively so that the cores 15 are temporarily excited to delete the magnetic path, the armatures 30 are swung around the torsion bars 42 to the printing position by the torsional energy of the bars 42 and the spring portions 44. Thereafter, the armatures 30 are restored to and held in the rest position by the magnetic force of the permanent magnet 18. As the printing wires 32 reciprocate in response to the alternating swing of the armatures 30, dots are formed on a printing sheet (not shown) on the platen 31 through the medium of a printing ribbon (not shown) interposed between the print head and the platen 31.

As the armatures 30 swing, in the embodiment described above, twisting and bending moments are applied to the torsion bars 42 and the leaf spring portions 44, respectively. Accordingly, stress concentration on both ends of each torsion bar 42 is eased, so that the print head is improved in durability. Also, the weight of tee armatures 30 acting on the leaf spring portions 44 is reduced, so that the spring portions 44 can be formed from a less resilient, thinner material. Thus, the leaf spring portions 44 suffer less high-order vibration, so that the printing cycle time is shortened. In consequence, the arrangement of this embodiment permits high-speed printing.

Processes of assembling the print head according to this embodiment will now be described. The assembling work is performed along the axis X—X of the print head. First, the spacers 27 and 28 and the supporting plate 26 are put successively on the flat plate portion 34 in a manner such that their respective engaging portions 68, 69 and 70 are situated corresponding to the positioning projections 60 of the nose 33. Then, by engaging the positioning projections 60 with the engaging portions 68, 69 and 70, the members 27, 28 and 26 are tacked to the nose 33 in positioned relation. Subsequently, the armatures 30, previously fitted with the print wires 32, are positioned on their corresponding supporting pieces 29 of the supporting plate 26 by using a jig or the like, and the wires 32 are inserted into the guide portion 35.

Electron beams are applied to the two points P (FIGS. 1 and 3) on each armature 30 through apertures 77 (two for each armature) bored through the flat plate portion 34. Thus, the armatures 30 are welded to the coupling portions 43 of their corresponding supporting pieces 29. Namely, electron beams are applied to those surfaces of the coupling portions 43 opposite to the surfaces thereof facing the armatures 30. Thus, the armatures 30 and the coupling portions 43 are welded together at the points P on the armatures 30, as indicated by broken line in FIG. 1.

Thereafter, the jig is removed, and the front yoke 24 is attached to the tacked nose 33 so that the armatures 30 are located in their corresponding slits 25. The distal ends of the print wires 32, projecting from the guide portion 35, are pushed toward the armatures 30, thereby moving the armatures 30 against the resilience of the torsion bars 42 and the leaf spring portions 44. Thus, the armatures 32 are situated as if they were attracted to the permanent magnet 18, as mentioned before. In this state, the end faces of the armatures 30 opposed to the cores 15 are ground to be substantially flush with the end face of the front yoke 24 opposed to the spacer 23.

Meanwhile, an unmagnetized plate material for the permanent magnet 18 and the spacer 23 are joined together and fixed on the rear yoke 13 of the head body 11 by means of a bonding agent. Thereafter, the cores 15 and the spacer 23 are ground so that the end faces of the cores 15 are flush with the front face of the spacer 23. Then, the film 22 is pressed against the end faces of the cores 15 and the front face of the spacer 23 to be fixed thereon, while being heated as required.

Thereafter, the front yoke 24, spacer 23, permanent magnet 18, and rear yoke 13 are joined successively in a manner such that the engaging portions 67, 66, 65 and 63 of the head body 11, with the spacer 23 and the material of the magnet 18 fixed thereon, are situated corresponding to the positioning projections 60 of the nose 33. As the positioning projections 60 engage their corresponding engaging portions, the aforesaid members are tacked to the nose 33 in positioned relation. Thus, the cores 15 on the head body 11 and the armatures 30 are positioned.

In attaching the head body 11 to the nose 33, the slanting surfaces of the retaining pieces 62 for tacking are caused to engage the bottom surfaces of their corresponding retaining recesses 75, so that the retaining pieces 62 are moved outward against their own resilience. When the projecting parts of the retaining pieces 62 face their corresponding notches 61 of the rear yoke 13, the pieces 62 are restored so that their projecting parts are located individually in the notches 61. As the retaining pieces 62 engage the notches 61 in this manner, the head body 11 is restrained from moving rearward. Thus, the tacking work is finished.

Subsequently, if the material of the permanent magnet 18 is magnetized, the members 11, 23, 24, 26, 27 and 28 are coupled firmly to one another by the magnetic force of the magnet 18. Finally, the coupling member 71 is attached to the nose 33 so that its retaining pieces 76 engage their corresponding retaining recesses 75 of the rear yoke 13. Thereupon, the nose 33 is coupled to the head body 11, and the assembling of the print head is finished.

Thus, according to the present embodiment, the cores 15 and the armatures 30 are positioned through the engagement between the positioning projections 60, which protrude from the plastic nose 33, and the respective engaging portions 70 and 63 of the supporting plate 26 and the rear yoke 13. Accordingly, the armatures 30 can accurately be positioned relatively to their corresponding cores 15. Also, the assembling work is easy, an the manufacturing cost can be lowered.

Moreover, the positioning projections 60 are provided individually with the retaining piece 62 for tacking, while the rear yoke 13 is formed with the notches 61. With this arrangement, the head body 11 and the other members can be tacked securely to the nose 33. Thus, in transporting the print head between the assembling processes, before magnetizing the material of the permanent magnet 18, the print head can be prevented securely from being disassembled.

Referring now to FIG. 7, a second embodiment of the present invention will be described. In FIGS. 1 to 7, like reference numerals refer to the same parts throughout the drawings. The following is a description of differences between the first and second embodiments, in particular. The second embodiment differs from the first embodiment in that one end of each pair of arms 46 of each leaf spring portion 44 is coupled to the coupling ring 45 by means of a common bridge piece 80, which is situated on the axis Y—Y, and that the other ends of the arms 46 are coupled to the coupling portion 43 by means of a pair of second torsion bars 81. Thus, the second embodiment can produce the same effect of the first embodiment. Besides, the additional use of the second torsion bars 81 further eases stress concentration, thereby improving the durability of the print head. According to the second embodiment, furthermore, the one end of the leaf spring portion 44 is fixed to the coupling ring 45 of the supporting plate 26 by means of the bridge piece 80 with a narrow width. Therefore the equivalent mass of the leaf spring portions 44 near the print wires 32 of the armatures 30 can be reduced, so that the printing operation can be accomplished securely with use of less driving energy. Also in the second embodiment, the supporting plate 26, along with a plurality of supporting pieces 29, can be produced by punch-pressing or etching a plate material.

The present invention is not limited to the embodiments described above. For example, the invention may be applied also to a print head of a type in which print wires are moved to the printing position as armatures are driven by attraction produced by electromagnetic devices.

Although the armature supporting structure of the present invention has been described in connection with the first and second embodiments, it is to be understood that the scope or spirit of the invention is not limited to those precise embodiments.

In the embodiments described above, for example, each pair of torsion bars 42 and each corresponding pair of leaf spring portions 44 are coupled integrally by means of the coupling portion 43 of the supporting plate 26. Alternatively, however, the torsion bars 42 and the leaf spring portions 44 may be fixed independently to their corresponding armatures 30, without using the coupling portions 43.

In the above described embodiments, moreover, each pair of leaf spring portions 44 are arranged symmetrically on either side of the coupling portion 43, with respect to the axis Y-Y, so that the leaf spring portions 44 can be bent in a well-balanced manner, and the armatures 30 can be supported with high stability. Alternatively, however, only one leaf spring portion may be provided for each coupling portion 43 without departing from the scope or spirit of the invention.

What is claimed is:

1. A print head comprising:

a plurality of armatures;

resilient supporting means for swingably supporting the armatures;

a plurality of printing elements coupled individually to the armatures and serving to perform printing operation in response to the swinging action of the armatures; and electromagnetic means capable of operating so as to swing the armatures in one direction for the printing operation, said resilient supporting means including torsion bars coupled to the armatures in a first position along the longitudinal direction of the armatures, and leaf spring members coupled to the armatures in a second position different from the first position, along the longitudinal direction of the armatures, and each having an arm portion bendable in the longitudinal direction of the armatures.

2. The print head according to claim 1, wherein said torsion bars are paired so as to extend on either side of each said armature from said first position, in a direction transverse to the longitudinal direction of the armature.

3. The print head according to claim 2, wherein said leaf spring members are paired so as to be arranged on either side of each said armature, with respect to the longitudinal direction of the armature, one end of each said leaf spring member being coupled to the armature at said second position.

4. The print head according to claim 3, wherein said resilient supporting means further includes coupling members extending in the longitudinal direction of their corresponding armatures and coupled to the armatures, and each said pair of torsion bars and each said pair of leaf spring members are formed integrally with each said coupling member.

5. The print head according to claim 4, wherein each said coupling member includes a portion extending further from said second position, in the opposite direction to said first position.

6. The print head according to claim 4, wherein said resilient supporting means further includes first and second fixed members and both fixed to the print head and spaced in the longitudinal direction of the armatures; each said pair of torsion bars are coupled to the first fixed member; and each said pair of leaf spring members are coupled to the second fixed member.

7. The print head according to claim 6, wherein said torsion bars, leaf spring members, coupling members, and first and second fixed members are formed by punch-pressing a flat plate material.

8. The print head according to claim 6, wherein said torsion bars, leaf spring members, coupling members, and first and second fixed members are formed by etching a flat plate material.

9. The print head according to claim 6, wherein each said pair of torsion bars and each said leaf spring members corresponding thereto are symmetrical with respect to an axis extending along the longitudinal direction of each corresponding armature.

10. The print head according to claim 6, wherein each said coupling member is welded to its corresponding armature by means of an electron beam applied to that surface of the coupling member opposite to the surface thereof facing the armature.

11. The print head according to claim 6, wherein said coupling members of said resilient supporting means extend radially from a central axis of the print head so as to be arranged at predetermined angles to one another, and said second fixed member is in the form of a ring situated inside the first fixed member with respect to the radial direction.

12. The print head according to claim 1, wherein each said leaf spring member includes a second torsion bar between the arm portion and the one end of the leaf spring member coupled to the armature corresponding thereto.

13. The print head according to claim 12, wherein said torsion bars are paired so as to extend on either side of each said armature from said first position, in a direction transverse to the longitudinal direction of the armature; said leaf spring members are paired so as to be arranged on either side of each said armature, with respect to the longitudinal direction of the armature; and the respective other ends of each said pair of leaf spring members are coupled to a bridge portion situated on an axis extending along the longitudinal direction of the armature.

* * * * *